US009221285B2

(12) United States Patent
Shiohara

(10) Patent No.: US 9,221,285 B2
(45) Date of Patent: Dec. 29, 2015

(54) IMAGE RECORDING APPARATUS

(71) Applicant: Yukio Shiohara, Nagoya (JP)

(72) Inventor: Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 2 days.

(21) Appl. No.: 14/039,201

(22) Filed: Sep. 27, 2013

(65) Prior Publication Data

US 2014/0092163 A1 Apr. 3, 2014

(30) Foreign Application Priority Data

Sep. 28, 2012 (JP) ..... 2012-217557

(51) Int. Cl.
*B41J 29/38* (2006.01)
*B41J 29/46* (2006.01)
*B41J 29/02* (2006.01)

(52) U.S. Cl.
CPC *B41J 29/46* (2013.01); *B41J 29/02* (2013.01); *B41J 29/38* (2013.01)

(58) Field of Classification Search
USPC ..... 347/3, 4, 5, 9, 19, 16
See application file for complete search history.

(56) References Cited

FOREIGN PATENT DOCUMENTS

JP 06008581 * 1/1994
JP 2004-128690 A 4/2004

* cited by examiner

*Primary Examiner* — Lam Nguyen
(74) *Attorney, Agent, or Firm* — Baker Botts L.L.P.

(57) ABSTRACT

This image recording apparatus comprises: a sheet accommodation portion configured to accommodate a sheet therein; a conveyance mechanism configured to convey the sheet along a conveyance direction from the sheet accommodation portion; a recording unit configured to record an image onto the sheet conveyed by the conveyance mechanism; a housing accommodating the conveyance mechanism and the recording unit and having therein open space that opens toward an outside of the image recording apparatus while holding the sheet accommodation portion; and a speaker disposed inside the housing and configured to output sound to the open space.

13 Claims, 13 Drawing Sheets

IMAGE RECORDING APPARATUS

CROSS-REFERENCE TO RELATED APPLICATION

This application claims priority from Japanese Patent Application No. 2012-217557, filed on Sep. 28, 2012, which is incorporated herein by reference.

BACKGROUND OF THE DISCLOSURE

1. Field of the Disclosure

The disclosure relates generally to an image recording apparatus including a speaker.

2. Description of Related Art

A known image recording apparatus includes a speaker that outputs a warning beep to inform a user of, for example, an occurrence of a trouble in the image recording apparatus or an occurrence of a paper-out condition. Generally, in the known image recording apparatus, the speaker is disposed inside a housing of the image recording apparatus and is configured to emit sound to the outside of the housing through small holes that go through a wall of the housing. Another image recording apparatus includes a speaker unit disposed outside its housing.

In recent years, still another image recording apparatus is capable of providing voice guidance, such as an explanation of an occurring trouble or instructions to perform an operation by a user, as well as outputting a warning beep. In order to make the voice guidance more like natural human speech, the image recording apparatus is required to output sound at a higher volume level in a wide sound range as compared with a case where the image recording apparatus outputs a warning beep only.

SUMMARY OF THE INVENTION

Nevertheless, in a case where the speaker is disposed inside the housing as described above, there may be a probability that the image recording apparatus may be damaged due to entry of foreign matter (e.g., a substance, such as liquid or metal piece, which may cause a serious problem on an electric system) and/or static electricity (which may cause a breakdown of a device mounted on a circuit) through the small holes defined in the side wall of the housing. Further, in the known speaker attachment manner in which there is no space left in front of the speaker, it may be difficult to ensure an enough volume level and an enough sound range. Nevertheless, attaching the speaker unit on the housing externally may be not realistic from the viewpoint of reducing a size of the image recording apparatus.

Accordingly, the present invention may provide an image recording apparatus in which entry of foreign matter into an inside of the image recording apparatus may be prevented or reduced and sound quality of a speaker may be improved.

According to an embodiment of the invention, an image recording apparatus may include.

According to the aspects of the invention, the image recording apparatus in which the entry of foreign matter into the inside of the image recording apparatus may be prevented or reduced and the sound quality of the speaker may be improved, may be implemented.

Other objects, features, and advantages will be apparent to persons of ordinary skill in the art from the following detailed description of the invention and the accompanying drawings.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION OF EMBODIMENTS OF THE INVENTION

Figure 1:
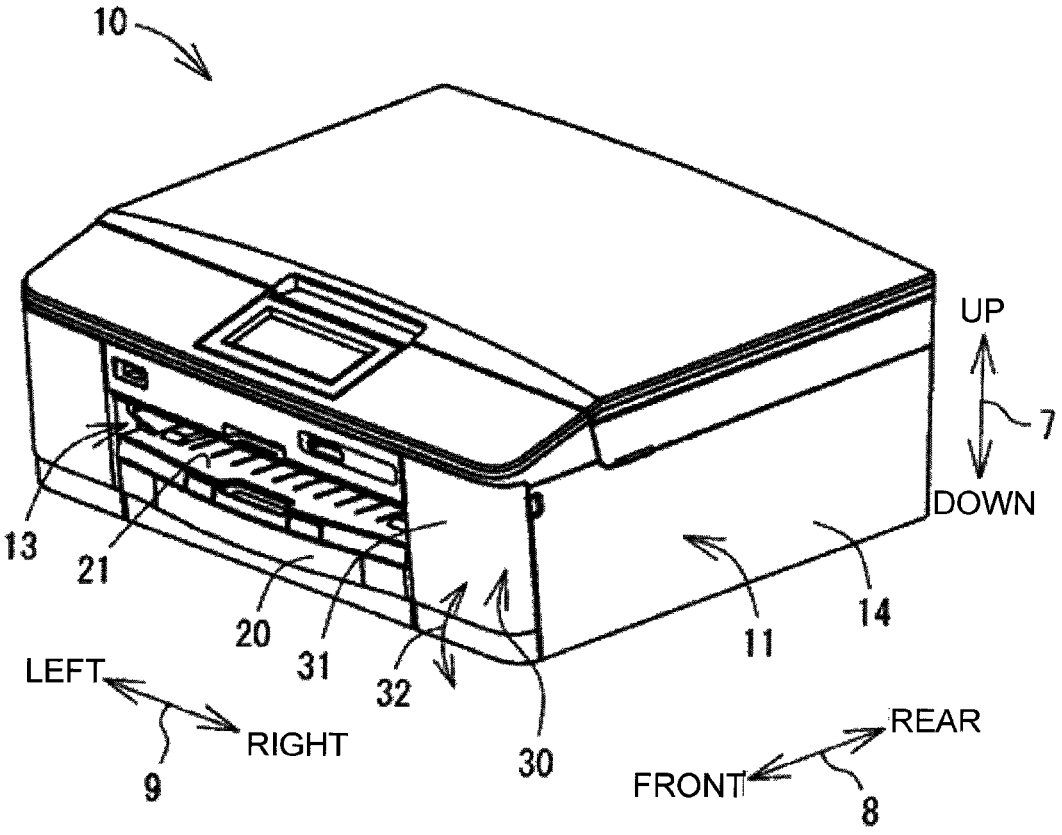
FIG. 1 is a perspective view depicting an appearance of a multifunction device according to an embodiment of the invention.

An embodiment according to one or more aspects is described below with reference to the accompanying drawings. The embodiment described below is merely an example. Various changes, arrangements and modifications may be applied therein without departing from the spirit and scope of the invention. In the description below, an up-down direction 7 may be defined with reference to an orientation of a multifunction device 10 that may be disposed in an orientation in which it may be intended to be used (e.g., an orientation depicted in FIG. 1). A side of the multifunction device 10, in which an opening 13 may be defined, may be defined as the front of the multifunction device 10. A front-rear direction 8 may be defined with reference to the front of the multifunction device 10. A right-left direction 9 may be defined with respect to the multifunction device 10 as viewed from the front of the multifunction device 10.

As depicted in FIG. 1, the multifunction device 10 as an example of an image recording apparatus may have a substantially thin rectangular parallelepiped body and may comprise a printer unit 11 using an inkjet recording method in its lower portion. The multifunction device 10 may have various functions, for example, a facsimile function and a printing function.

As depicted in FIG. 1, the printer unit 11 may comprise a housing 14 whose front may have the opening 13 defined therein. A feed tray 20 may be configured to be inserted into and removed from the printer unit 11 via the opening 13 in the front-rear direction 8. One or more recording sheets having a desired size may be placed on the feed tray 20. A discharge tray 21 may be disposed above the feed tray 20. A sheet accommodation portion might not be limited to the configuration of the above-described feed tray 20, but may comprise any configuration capable of accommodating one or more sheets, such as a feed cassette or a feed stand.

Figure 2:
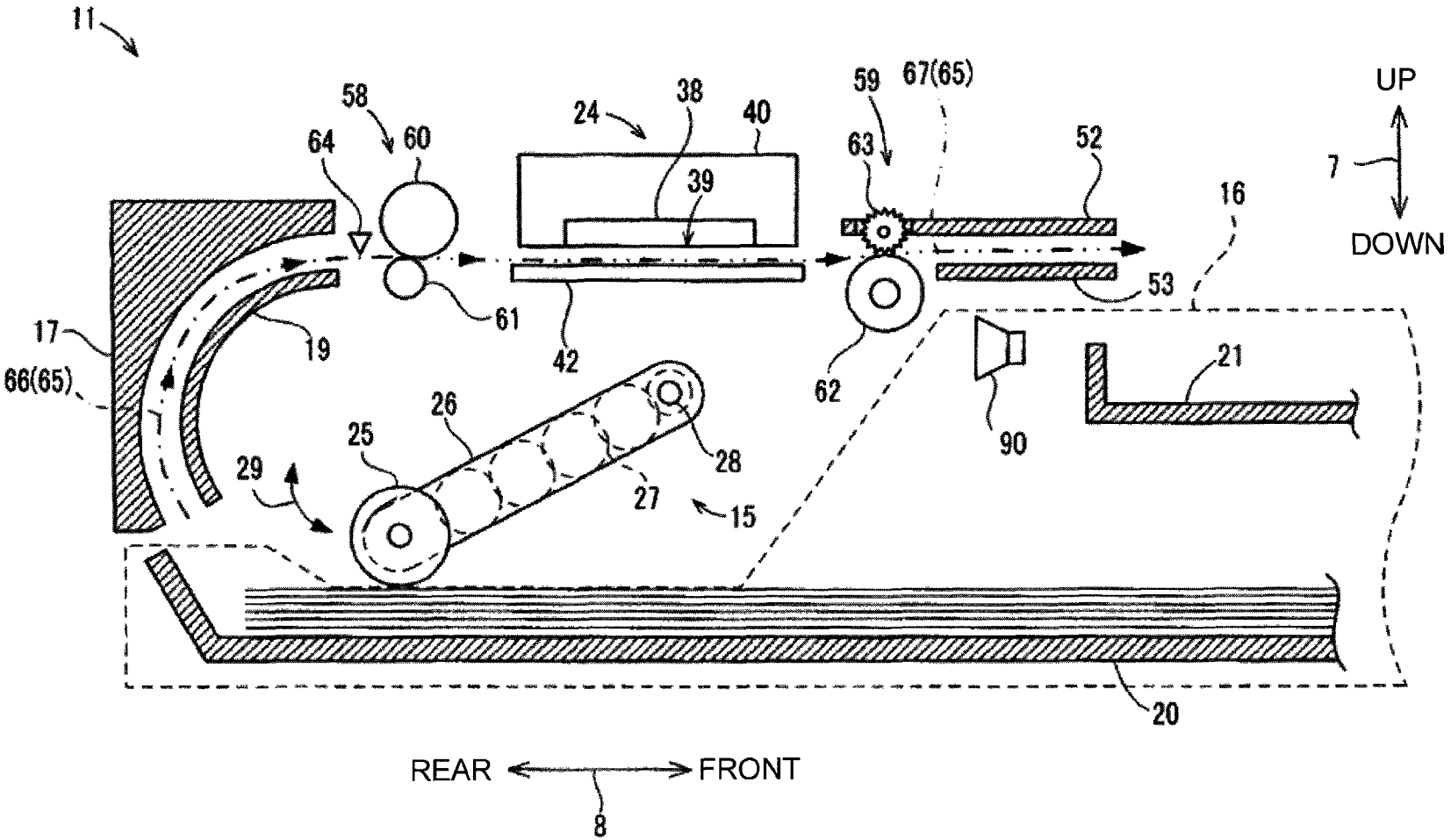
FIG. 2 is a schematic cross-sectional view depicting an internal configuration of a printer unit according to an embodiment of the invention.

As depicted in FIG. 2, the printer unit 11 may mainly comprise a feed unit 15, a conveyor roller pair 58, a discharge roller pair 59, and a recording unit 24. The feed unit 15 may feed one or more recording sheets. The conveyor roller pair 58 and the discharge roller pair 59 may convey a recording sheet one by one. The recording unit 24 may record an image onto a recording sheet using the inkjet recording method. The printer unit 11 may record an image onto a recording sheet based on print data received from an external device.

The housing 14 may accommodate a frame 70 (see FIGS. 3 and 4) therein. The frame 70 may retain members constituting the printer unit 11. As depicted in FIGS. 2 and 4, the inside of the housing 14 may be partitioned by the frame 70 and the housing 14 may have open space 16 inside thereof.

The open space 16 may be space for accommodating the feed tray 20 and the discharge tray 21. The open space 16 may be in communication with the outside of the housing 14 via the opening 13 while accommodating therein the feed tray 20 and the discharge tray 21. That is, the feed tray 20 and the discharge tray 21 might not close the opening 13 completely. The open space 16 may extend inside the printer unit 11 in the front-rear direction 8 (e.g., a depth direction) from the opening 13. More specifically, in the front-rear direction 8, an upper side of the open space 16 may open from the front of the printer unit 11 to a substantially middle portion of the printer unit 11 and a lower side of the open space 16 may open from the front of the printer unit 11 to a substantially backmost portion of the printer unit 11. A conveyance path 65 and components of the printer unit 11 may be disposed in adjacent areas of the open space 16.

As depicted in FIG. 2, the feed unit 15 may be disposed above the feed tray 20, that is, above the open space 16. The feed unit 15 may comprise a feed roller 25, a feed arm 26, and a power transmission mechanism 27. The power transmission mechanism 27 may comprise a plurality of gears engaged with one another. The feed roller 25 may be supported by a shaft at a distal end portion of the feed arm 26. The feed arm 26 may be configured to swing in directions indicated with an arrow 29 on a shaft 28 disposed on a proximal end portion of the feed arm 26. With this configuration, the feed roller 25 may be capable of coming into contact with and coming apart from the one or more recording sheets placed on the feed tray 20. The feed roller 25 may rotate by transmission of a drive force from a sheet feed motor 102 (see FIG. 6) by the power transmission mechanism 27. While contacting an uppermost recording sheet of the one or more recording sheets placed on the feed tray 20, the feed roller 25 may separate the uppermost recording sheet from the rest of recording sheets and feed the separated recording sheet into a curved section 66 of the conveyance path 65. Hereinafter, this operation may be referred to as a "pickup of a recording sheet".

As depicted in FIG. 2, the conveyance path 65 through which a recording sheet may pass may be defined inside the printer unit 11. The conveyance path 65 may extend from one end (e.g., a rear end) of the feed tray 20 to the discharge tray 21 via the recording unit 24. A recording sheet may be conveyed in the conveyance path 65 along a conveyance direction from the feed tray 20 to the discharge tray 21. The conveyance path 65 may comprise the curved section 66 and a straight section 67. The curved section 66 may extend from the one end of the feed tray 20 to the conveyor roller pair 58. The straight section 67 may extend from the conveyor roller pair 58 and pass under the recording unit 24 to the discharge tray 21.

The curved section 66 may be a curved path that may extend from the one end of the feed tray 20 to the conveyor roller pair 58. The curved section 66 may be defined behind the open space 16. A recording sheet may be guided in the curved section 66 (e.g., a section indicated by a dot and dashed line in FIG. 2) along a conveyance direction (e.g., a direction indicated by arrows attached to the dot and dashed line in FIG. 2). The curved section 66 may join the straight section 67 at the conveyor roller pair 58. Therefore, the recording sheet may be guided into the straight section 67 via the curved section 66. The curved section 66 may be defined by an inside guide member 19 and an outside guide member 17 that may face each other and be spaced apart from each other at a predetermined interval.

The straight section 67 may be a straight path that may extend from a downstream end of the curved section 66 in the conveyance direction, that is from the conveyor roller pair 58, to the discharge tray 21, along the front-rear direction 8. The straight section 67 may be defined above the open space 16. A recording sheet may be guided in the straight section 67 (e.g., a section indicated by a double-dot and dashed line in FIG. 2) along a conveyance direction (e.g., a direction indicated by arrows attached to the double-dot and dashed line in FIG. 2). The recording sheet may be discharged onto the discharge tray 21 after an image is recorded thereon by the recording unit 24. The straight section 67 may be defined by the recording unit 24 and a platen 42, which may face each other and be spaced apart from each other at a predetermined interval, at a position where the recording unit 24 may be disposed. The straight section 67 may be defined by an upper guide member 52 and a lower guide member 53, which may face each other and be spaced apart from each other at a predetermined interval, at a position where the recording unit 24 might not be disposed.

As depicted in FIG. 2, the recording unit 24 may be disposed on an upper side in the straight section 67. That is, the recording unit 24 may be disposed above and at the back of (behind) the open space 16. The recording unit 24 may comprise a recording head 38 and a carriage 40. The recording head 38 may eject ink from nozzles, as fine ink droplets. The carriage 40 may be equipped with the recording head 38 and reciprocate in a main scanning direction, that is, in the right-left direction 9 perpendicular to a surface of the drawing sheet of FIG. 2.

Figure 3:
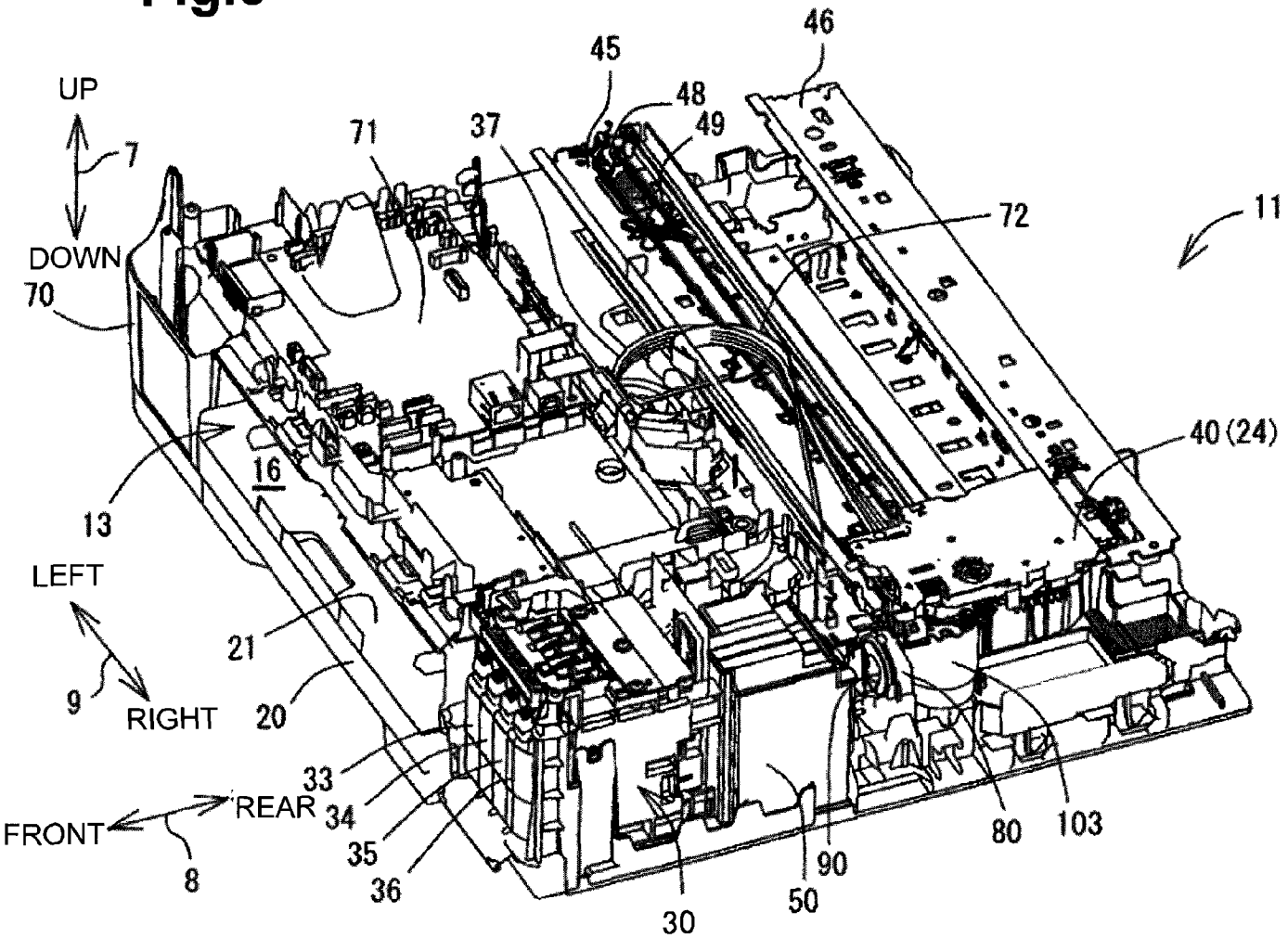
FIG. 3 is a perspective view depicting the internal configuration of the printer unit according to an embodiment of the invention.
Figure 4:
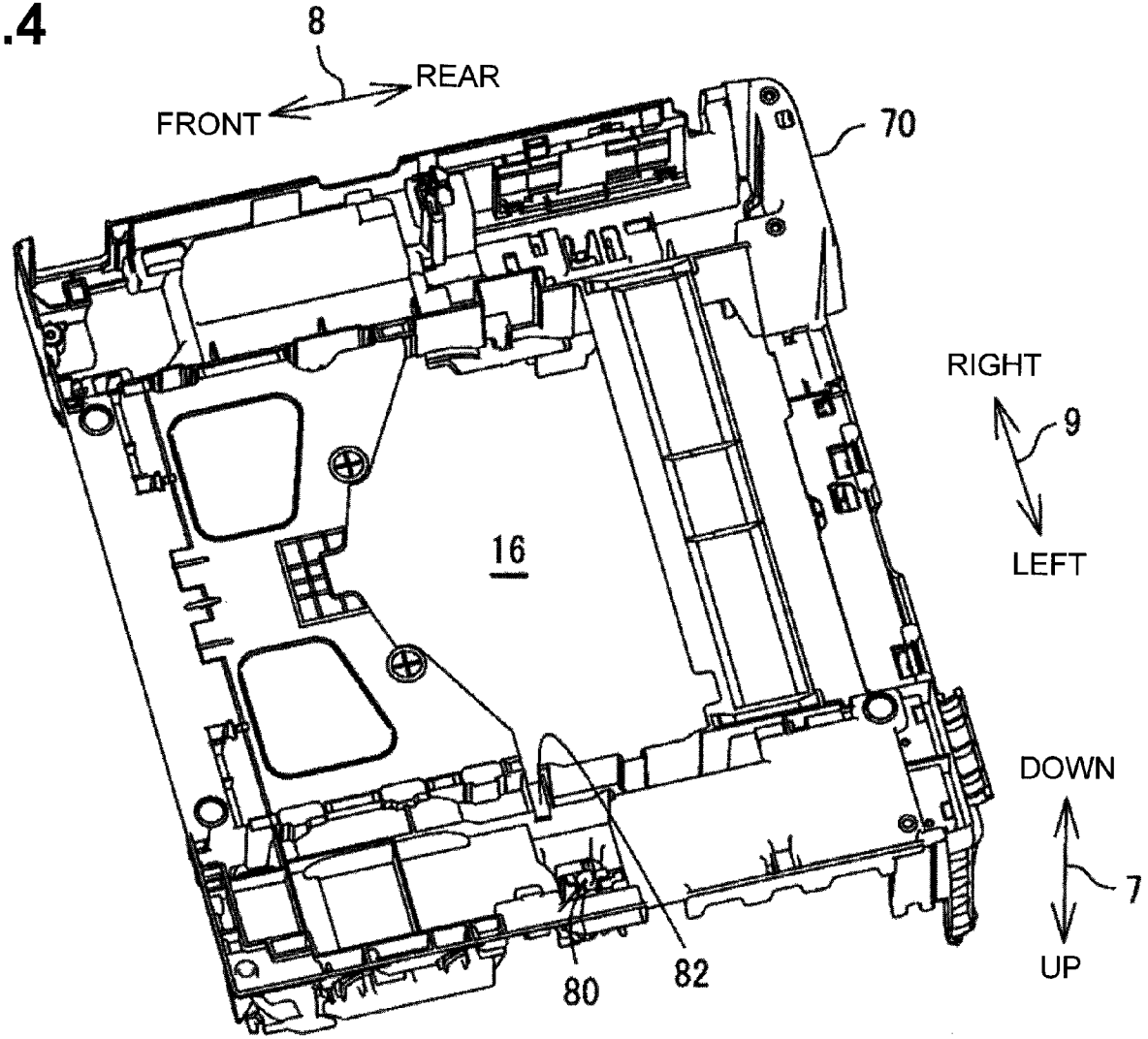
FIG. 4 is a bottom perspective view depicting a frame according to an embodiment of the invention.

The recording head 38 mounted on the carriage 40 may be supplied with ink from ink cartridges 33, 34, 35, and 36 (see FIG. 3). The nozzles may be defined in a nozzle surface 39 that may be a lower surface of the recording head 38. The nozzles may eject ink droplets toward the platen 42 that may define a lower portion of the straight section 67 and face the recording unit 24 spaced apart from the platen 42 at a predetermined interval. The recording sheet being conveyed in the conveyance direction may be supported by the platen 42.

With this configuration, while the carriage 40 reciprocates along the main scanning direction, ink droplets may be ejected from the nozzles toward the recording sheet supported by the platen 42. Thus, an image may be recorded on a certain area of a recording surface of the recording sheet conveyed by the conveyor roller pair 58. The certain area may be an area, facing the nozzle surface 39, of the recording surface of the recording sheet supported by the platen 42 when the carriage 40 reciprocates along the main scanning direction. In other words, the certain area may a band area that may have a width corresponding to an interval between a most upstream nozzle and a most downstream nozzle in the nozzle surface 39 in the conveyance direction and be elongated in the main scanning direction.

As depicted in FIG. 3, the carriage 40 may be supported by guide rails 45 and 46. The guide rails 45 and 46 may be attached on the frame 70 disposed inside the printer unit 11. The guide rails 45 and 46 may be disposed side by side in the front-rear direction 8 in a rear portion of the housing 14 and extend in the right-left direction 9, respectively. The carriage 40 may be mounted on the guide rails 45 and 46 to bridge between the guide rails 45 and 46 so as to be capable of moving in the right-left direction 9.

A drive pulley (not depicted), a following pulley 48, and an endless annular belt 49 may be disposed on an upper surface of the guide rail 45. The drive pulley may be disposed on a vicinity of a right end of the guide rail 45 in the right-left direction 9. The following pulley 48 may be disposed on a vicinity of a left end of the guide rail 45 in the right-left direction 9. The endless annular belt 49 may be hung between the drive pulley and the following pulley 48. A drive shaft of a carriage drive motor 103 for driving the carriage 40 may be coupled to a shaft of the drive pulley. As a rotational drive force of the carriage drive motor 103 is transmitted to the drive pulley, the drive pulley may rotate and thus the belt 49 may rotate in a circumferential direction. A bottom of the carriage 40 may be connected to the belt 49. Therefore, as the belt 49 rotates in the circumferential direction, the carriage 40 may move on the guide rails 45 and 46 along the right-left direction 9.

As depicted in FIG. 2, the conveyor roller pair 58 may comprise a conveyor roller 60 and a pinch roller 61 and be disposed upstream of the recording unit 24 in the straight section 67 with respect to the conveyance direction. The conveyor roller 60 may be disposed on the upper side in the straight section 67, and the pinch roller 61 may be disposed on a lower side in the straight section 67 and face the conveyor roller 60. The conveyor roller pair 58 may be disposed above and at the back of (behind) the open space 16. The pinch roller 61 may be in pressure contact with a roller surface of the conveyor roller 60 by an elastic member (not depicted) such as a spring. The conveyor roller pair 58 may pinch and convey a recording sheet downstream in the conveyance direction (i.e., toward the platen 42). The conveyor roller pair 58 may convey the recording sheet intermittently by a predetermined line feed width. Hereinafter, this operation performed by the conveyor roller pair 58 may be referred to as a "process of conveying a recording sheet by a predetermined line feed width during image recording", that is, an "intermittent conveyance process". The predetermined line feed width may be narrower than the width of the certain area of the recording surface of the recording sheet.

The discharge roller pair 59 may comprise a discharge roller 62 and a spur 63 and be disposed downstream of the recording unit 24 in the straight section 67 with respect to the conveyance direction. The discharge roller 62 may be disposed on the lower side in the straight section 67, and the spur 63 may be disposed on the upper side in the straight section 67 with facing the discharge roller 62. The discharge roller pair 59 may be disposed above the open space 16. The spur 63 may be in pressure contact with a roller surface of the discharge roller 62 by an elastic member (not depicted) such as a spring. The discharge roller pair 59 may pinch and convey downstream (i.e., toward the discharge tray 21) the recording sheet that has passed the recording unit 24 with respect to the conveyance direction.

Figure 6:
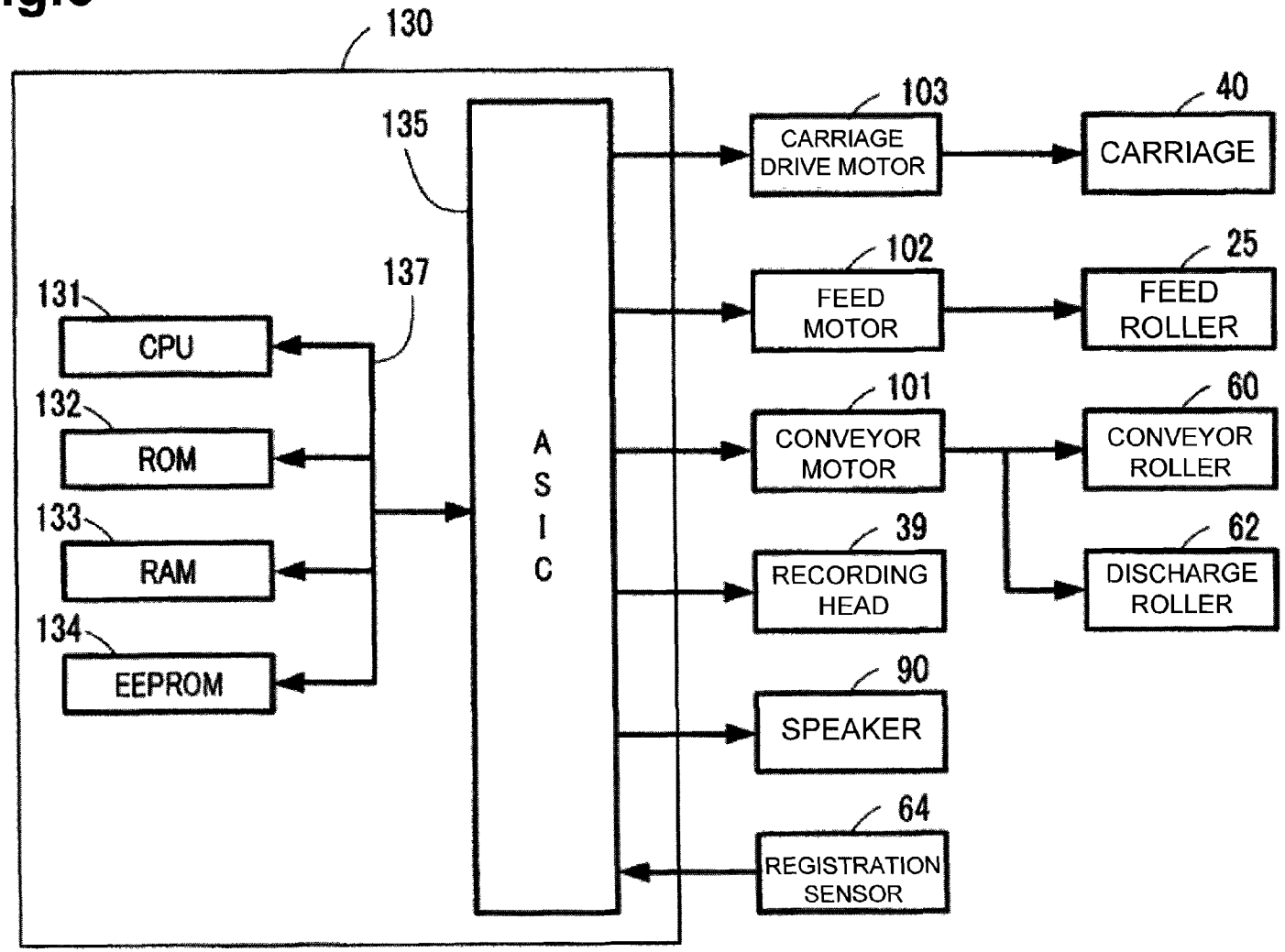
FIG. 6 is a block diagram depicting a configuration of a control device according to an embodiment of the invention.

The conveyor roller 60 and the discharge roller 62 may rotate by transmission of a drive force from a conveyor motor 101 (see FIG. 6). When the conveyor motor 101 rotates in one of a normal direction and a reverse direction, the conveyor roller 60 and the discharge roller 62 may convey the recording sheet in the conveyance path 65 along the conveyance direction.

As depicted in FIG. 2, the printer unit 11 may comprise a registration sensor 64 that may be disposed at a predetermined position between the feed roller 25 and the conveyor roller pair 58 in the curved section 66. The registration sensor 64 may detect the presence or absence of a recording sheet at the disposed position of the registration sensor 64 and output a detection signal to a control device 130 in accordance with the detection result. For example, when a portion of a recording sheet is present at the disposed position of the registration sensor 64, the registration sensor 64 may output a high-level signal (e.g., a signal whose signal level may be a threshold value or higher) to the control device 130. When no portion of a recording sheet is present at the disposed position of the registration sensor 64, the registration sensor 64 may output a low-level signal (e.g., a signal whose signal level may be lower than the threshold value) to the control device 130.

As depicted in FIGS. 1 and 3, a cartridge accommodation portion 30 may be disposed in a forward part of the printer unit 11. The cartridge accommodation portion 30 may be disposed adjacent to the open space 16 in the right-left direction 9. As depicted in FIG. 1, a cover 31 may be disposed at a right front position in the printer unit 11. The cover 31 may be capable of opening and closing by pivoting in a direction indicated by an arrow 32. When the cover 31 opens, the cartridge accommodation portion 30 may be exposed. The cartridge accommodation portion 30 may be a substantially rectangular parallelepiped box member having an opening.

The ink cartridges 33, 34, 35, and 36 may be inserted into and removed from the cartridge accommodation portion 30 via the opening, respectively. The cartridge accommodation portion 30 may have guide grooves (not depicted) in top and bottom surfaces. The ink cartridges 33, 34, 35, and 36 may be slid along the respective guide grooves to be inserted into and removed from the cartridge accommodation portion 30. In the embodiment, a plurality of, for example, four, guide grooves may be defined in each of the top surface and the bottom surface of the cartridge accommodation portion 30. In the embodiment, a plurality of, for example, four, ink cartridges 33, 34, 35, and 36 corresponding to respective colors of cyan, magenta, yellow, and black may be inserted into and removed from the cartridge accommodation portion 30.

The ink cartridges 33, 34, 35, and 36 storing ink of the respective colors may be attached to the cartridge accommodation portion 30 of the printer unit 11. As depicted in FIG. 3, a plurality of, for example, four, ink supply tubes 37 corresponding to ink of the respective colors may be routed from the cartridge accommodation portion 30 to the carriage 40. The ink supply tubes 37 routed to the carriage 40 may supply ink of the respective colors to the recording head 38 mounted on the carriage 40.

The ink supply tubes 37 may comprise, for example, synthetic resin and may be straight in shape. The ink supply tubes 37 may have appropriate stiffness (e.g., bending stiffness) to keep its straight shape. The ink supply tubes 37 may also have flexibility to bend by an application of an external force and elasticity to restore to the original shape by a release from the external force. Because the ink supply tubes 37 have such flexibility and elasticity, the shape of the ink supply tubes 37 may change following the reciprocation of the carriage 40.

As depicted in FIG. 3, a waste ink tank 50 may be disposed at the rear of the cartridge accommodation portion 30. That is, the waste ink tank 50 may be disposed adjacent to the open space 16 in the right-left direction 9. The waste ink tank 50 may be disposed also adjacent to and behind the cartridge accommodation portion 30. Waste ink ejected from the recording head 38 may be stored in the waste ink tank 50. More specifically, waste ink ejected by a purge operation for sucking ink from the nozzles by a pump (not depicted) or waste ink ejected by a flushing operation for idly ejecting ink from the nozzles may be stored in the waste ink tank 50.

As depicted in FIG. 3, an acoustic chamber 80 may be disposed integral with the frame 70 inside of the housing 14. The acoustic chamber 80 may be disposed adjacent to the open space 16 in the right-left direction 9. The acoustic chamber 80 may be disposed also adjacent to and behind the waste ink tank 50. The carriage drive motor 103 may be disposed behind the acoustic chamber 80. That is, the acoustic chamber 80 may be disposed between the waste ink tank 50 and the carriage drive motor 103 in the front-rear direction 8.

Figure 5:
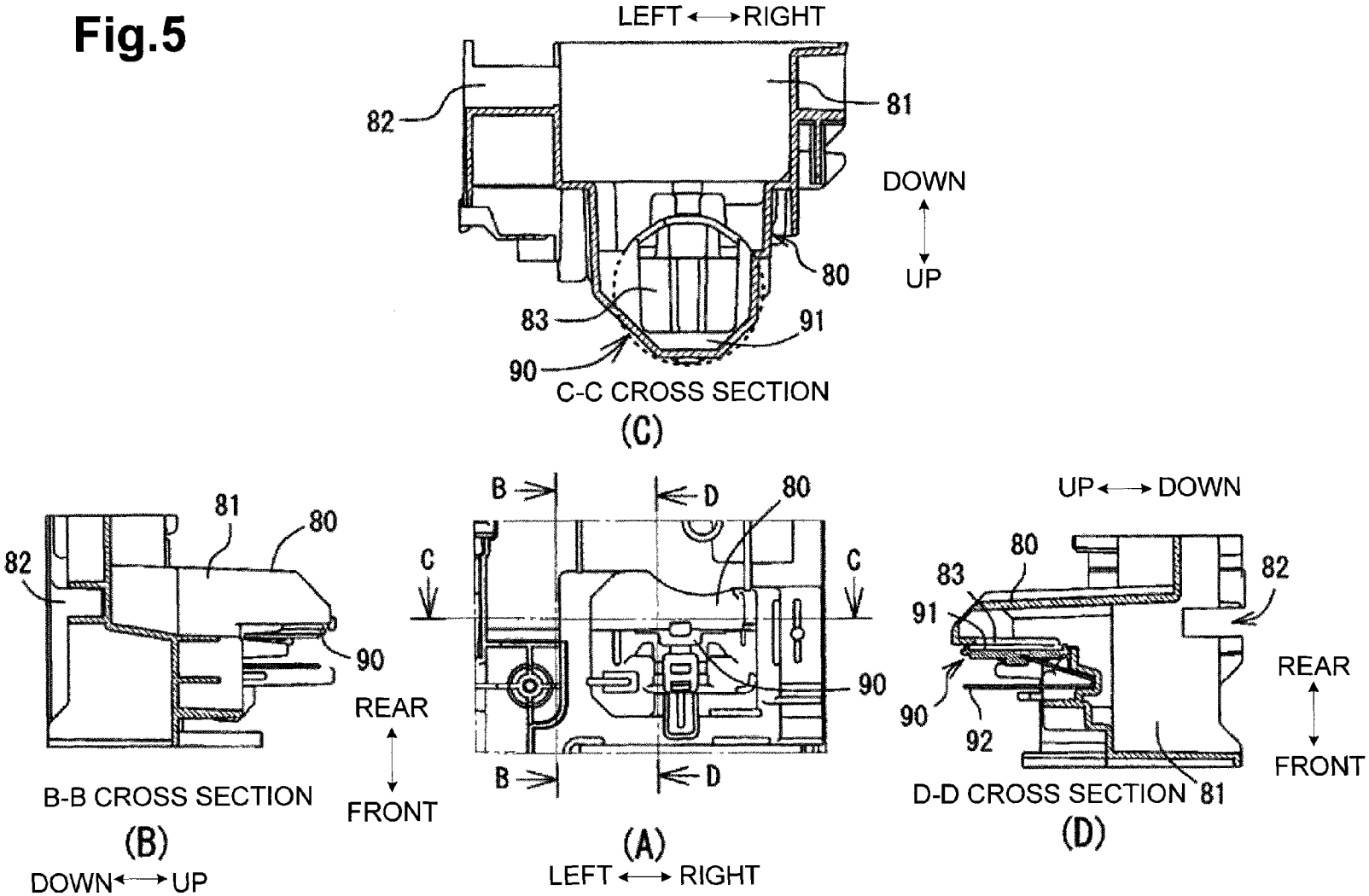
FIG. 5A is a plan view depicting an acoustic chamber according to an embodiment of the invention.
FIG. 5B is a sectional view of the acoustic chamber taken along a line B-B in FIG. 5A according to an embodiment of the invention.
FIG. 5C is a sectional view of the acoustic chamber taken along a line C-C in FIG. 5A according to an embodiment of the invention.
FIG. 5D is a sectional view of the acoustic chamber taken alone: a line D-D in FIG. 5A according to an embodiment of the invention.

The acoustic chamber 80 may have acoustic space 81 (see FIGS. 5A, 5B, 5C, and 5D) therein. As depicted in FIGS. 5B, 5C, and 5D, the acoustic chamber 80 may have a cone shape such that a cross-sectional area of the acoustic space 81 defined therein may become larger gradually from an upper portion to a lower portion of the acoustic chamber 80. As depicted in FIG. 4, the frame 70 may have an open bottom. Therefore, the acoustic chamber 80 may also have an open bottom. Thus, the acoustic space 81 may serve as another open space. The acoustic space 81 may be in communication with the open space 16 at its lower portion via a communication groove 82 that may be defined in a lower surface of the frame 70. As depicted in FIGS. 5A, 5B, 5C, and 5D, the acoustic chamber 80 may have an opening 83 in its upper front-facing wall. As depicted in FIG. 5C, an area of the opening 83 of the acoustic chamber 80 may be slightly smaller than an area (e.g., an area of a circle indicated by a dashed line) of a sound output surface 91 of a speaker 90.

That is, the acoustic chamber 80 may comprise a wall defining the acoustic space 81. In other words, the acoustic space 81 may be defined by a wall of the acoustic chamber 80. Nevertheless, the wall defining the acoustic space 81 might not be limited to the above-described example. In other embodiments, for example, one or more walls of one or more surrounding components (e.g., a rear wall of the waste ink tank 50) may be used to define the acoustic space 81.

The speaker 90 may be attached on an external wall of the acoustic chamber 80. More specifically, the speaker 90 may be in pressure contact with the upper front-facing wall of the acoustic chamber 80 by a leaf spring 92. The sound output surface 91 of the speaker 90 may be exposed to the acoustic space 81 via the opening 83 defined in the acoustic chamber 80. That is, the speaker 90 may be disposed such that the sound output surface 91 may be oriented toward the inside of the acoustic space 81. That is, sound outputted from the sound output surface 91 of the speaker 90 may transmit downward in the acoustic space 81 and then may be emitted into the open space 16 through the communication groove 82. Thereafter, the sound may be further emitted to the outside of the multifunction device 10 via the opening 13. As described above, the frame 70 may have the open bottom. Therefore, the sound outputted from the sound output surface 91 of the speaker 90 may transmit downward in the acoustic space 81 and may be emitted to the outside of the multifunction device 10 from the bottom of the frame 70.

The speaker 90 may output sound from the sound output surface 91 in accordance with a control of the control device 130. The sound outputted from the speaker 90 might not be limited to particular sound. For example, the sound outputted from the speaker 90 may include a warning beep for informing the user of an occurrence of abnormality in the multifunction device 10, voice guidance for providing instructions to perform a next operation, and a noise cancellation sound for cancelling operating noise caused in the multifunction device 10, which may be also referred to as "sound" collectively.

A detailed configuration of the speaker 90 might not be limited. For example, a piezoelectric-type speaker that may output sound by an application of voltage to a piezoelectric device (as an example of a piezoelectric body) may be adopted. With the adoption of such a speaker, the speaker 90 may have a thin body. In addition, the piezoelectric-type speaker might not comprise a magnet. Therefore, the speaker 90 might not have an adverse effect on a magnetic sensor and/or an electric circuit and a problem may be prevented from occurring due to absorption of surrounding iron powder. A method of manufacturing the speaker 90 might not be limited to a specific method. For example, the speaker 90 may be manufactured using the micro-electro-mechanical systems ("MEMS") manufacturing method.

As depicted in FIG. 3, a control board 71 may be fixed to the upper surface of the frame 70 using screws in a forward portion of the frame 70. The control board 71 may comprise a printed-circuit board (not depicted), a microcomputer mounted on the printed-circuit board, and various electronic components (e.g., a control circuit). For example, the microcomputer and the electronic components mounted on the control board 71 may constitute the control device 130 depicted in FIG. 6. The control board 71 and the recording head 38 may be electrically connected with each other by a flexible flat cable 72. The flexible flat cable 72 may have flexibility such that a shape of the flexible flat cable 72 may change following the reciprocation of the carriage 40.

The control device 130 may control a whole operation of the multifunction device 10. The aspects of the disclosure may be implemented by an execution of processes by the control device 130 in accordance with respective flowcharts. As depicted in FIG. 6, the control device 130 may comprise a central processing unit ("CPU") 131, a read-only memory ("ROM") 132, a random-access memory ("RAM") 133, an electrically erasable programmable read-only memory ("EEPROM") 134, an application-specific integrated circuit ("ASIC") 135, and an internal bus 137 that may connect these components to each other.

The ROM 132 may store programs for controlling various operations to be performed by the CPU 131. The RAM 133 may be used as a storage area for temporarily storing data and signals to be used when the CPU 131 carries out the program. The EEPROM 134 may store settings and flags that may need to be maintained after power of the multifunction device 10 is turned off. The EEPROM 134 may also store a noise cancellation sound, for example.

The conveyor motor 101, the sheet feed motor 102, and the carriage drive motor 103 may be connected to the ASIC 135. The ASIC 135 may be equipped with a drive circuit for controlling each motor. The CPU 131 may output a drive signal to the drive circuit (not depicted) to rotate a predetermined motor. The drive circuit may output a drive current corresponding to the drive signal acquired from the CPU 131 to the motor corresponding to the drive circuit. Thus, the corresponding motor may be rotated. That is, the control device 130 may control the driving (rotation) of each of the motors 101, 102, and 103.

More specifically, for example, the control device 130 may drive the sheet feed motor 102 to allow the feed roller 25 to feed a recording sheet. The control device 130 may drive the conveyor motor 101 to allow the conveyor roller pair 58 and the discharge roller pair 59 to convey the recording sheet. The control device 130 may drive the carriage drive motor 103 to allow the carriage 40 to reciprocate along the right-left direction 9.

A correspondence between each of the components constituting the multifunction device 10 and each of the motors 101, 102, and 103 for driving the components might not be limited to the example depicted in FIG. 6. In other embodiments, for example, all the feed roller 25, the conveyor roller 60 and the discharge roller 62 may be connected to one of the motors 101, 102, and 103 and a drive force of the one of the motors 101, 102, and 103 may be transmitted to the components by a power switching mechanism (not depicted).

The recording head 38 may be connected to the ASIC 135 via the flexible flat cable 72. The control device 130 may transmit a control signal to the recording head 38 through the flexible flat cable 72 to allow the nozzles to eject ink therefrom at a predetermined timing. Thus, an image may be recorded onto a recording sheet supported by the platen 42.

The speaker 90 may also be connected to the ASIC 135. The control device 130 may allow the speaker 90 to output therefrom sound, such as at least one of a warning beep, voice guidance, and a noise cancellation sound. A process for allowing the speaker 90 to output sound is described in detail below.

The registration sensor 64 may also be connected to the ASIC 135. The control device 130 may determine whether a signal level (e.g., a voltage value or a current value) of a detection signal inputted by the registration sensor 64 is a predetermined value or higher. When the signal level of the input detection signal is the predetermined value or higher, the control device 130 may determine that the input detection signal is a high-level signal. When the signal level of the inputted detection signal is lower than the predetermined value, the control device 130 may determine that the input detection signal is a low-level signal. When the input detection signal is a high-level signal (e.g., the registration sensor 64 is an ON state), the control device 130 may determine that a leading edge of a recording sheet has passed the disposed position of the registration sensor 64 and a trailing edge of the recording sheet has not been passed yet the disposed position of the registration sensor 64. That is, the control device 130 may determine that a portion of the recording sheet is present at the disposed position of the registration sensor 64. When the input detection signal is a low-level signal (e.g., the registration sensor 64 is in an OFF state), the control device 130 may determine that a leading edge of a recording sheet has not reached the disposed position of the registration sensor 64 yet or a trailing edge of the recording sheet has already passed the disposed position of the registration sensor 64. That is, the control device 130 may determine that no portion of the recording sheet is present at the disposed position of the registration sensor 64.

Referring to FIGS. 7 to 12, an image recording process performed by the control device 130 is described. The multifunction device 10 may cause various operating noises during the image recording process. Therefore, the control device 130 may perform process for allowing the speaker 90 to output an appropriate noise cancellation sound for cancelling sounding operating noise in synchronization with an operation of one or more components causing the operating noise in each stage in the image recording process of FIG. 7. This process is described below with reference to FIGS. 8 to 12.

The operating noise may be sound caused by an operation of one or more components constituting the multifunction device 10. The operating noise may include, for example, driving sound of each of the motors 101, 102, and 103, sound caused when a recording sheet is deformed, and sound caused when the carriage 40 slides on the guide rails 45 and 46. The operating noise and the noise cancellation sound may have substantially the same amplitude but opposite phases, respectively. A detailed description of a noise cancellation sound generation method is omitted. For example, the multifunction device 10 may be allowed to be in operation actually. Then, operating noise being caused in the multifunction device 10 that may operate actually may be collected by a microphone, and a known adaptive filter may be applied to the collected operating noise to generate noise cancellation sound having a phase reverse to a phase of the operating noise. The generated noise cancellation sound may be prestored in the EEPROM 134, for example.

Figure 7:
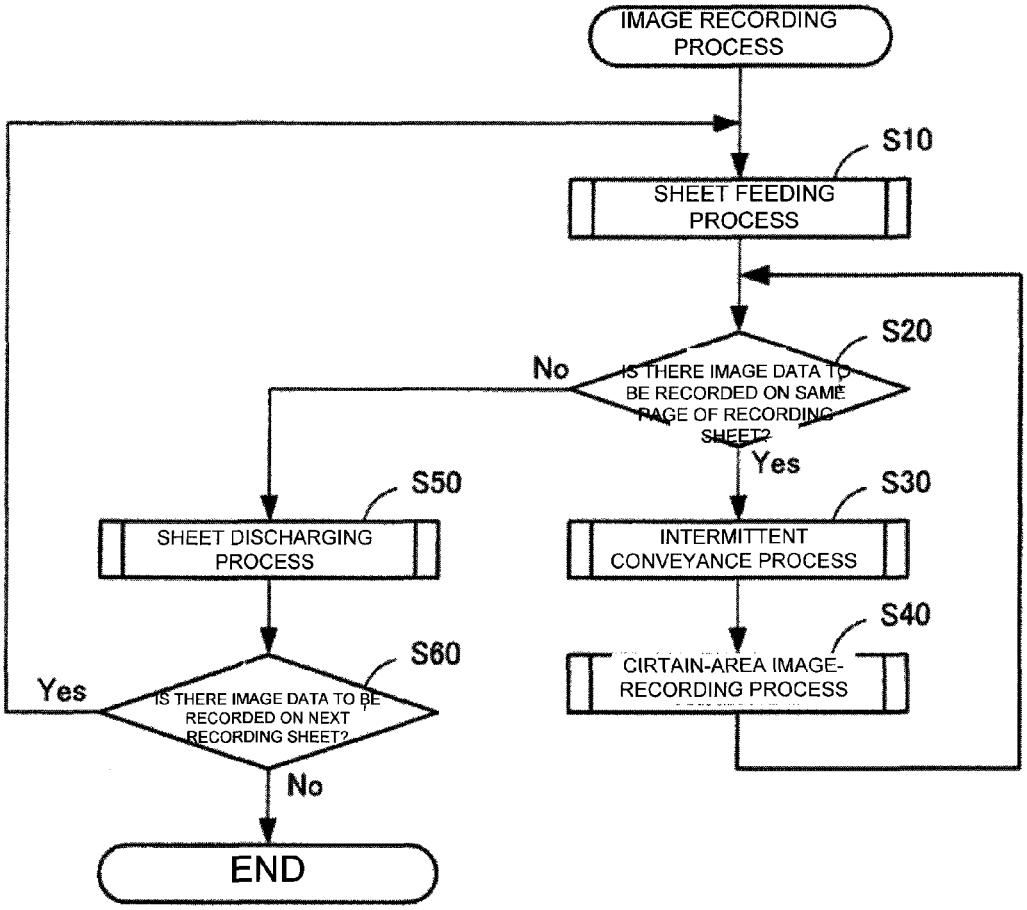
FIG. 7 is a flowchart depicting an image recording process according to an embodiment of the invention.
Figure 8:
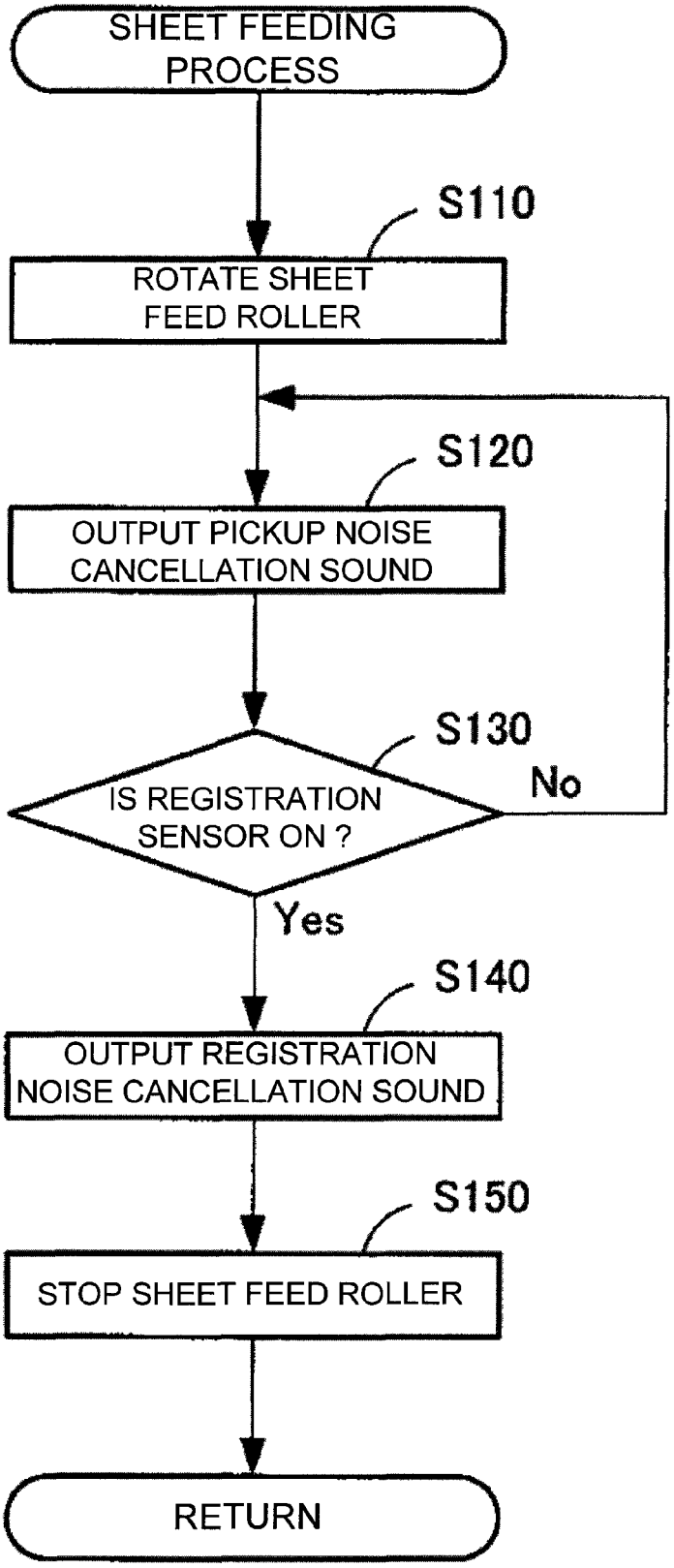
FIG. 8 is a flowchart depicting a sheet feeding process according to an embodiment of the invention.

As depicted in FIG. 7, as an instruction to start the image recording process is provided to the multifunction device 10, the control device 130 may perform a sheet feeding process (e.g., step S10). Referring to FIG. 8, the sheet feeding process is described in detail.

As depicted in FIG. 8, the control device 130 may drive the sheet feed motor 102 to rotate in a normal direction to rotate the feed roller 25 in a normal direction (e.g., a direction that may convey a recording sheet) (e.g., step S110). The control device 130 may drive the conveyor motor 101 to rotate in a reverse direction to rotate the conveyor roller 60 in a reverse direction (e.g., a direction opposite to the direction that may convey a recording sheet). Thus, an uppermost recording sheet of the one or more recording sheets placed on the feed tray 20 may be picked up and then conveyed toward the conveyor roller 60. At that time, the driving sound of the conveyor motor 101 and the sheet feed motor 102 and sound caused when the recording sheet being picked and a next recording sheet are rubbing may come out as the operating noise. Therefore, a noise cancellation sound (hereinafter, a "pickup noise cancellation sound") having a phase reverse to a phase of such operating noise may be prestored in the EEPROM 134.

The control device 130 may allow the speaker 90 to output the pickup noise cancellation sound stored in the EEPROM 134, in synchronization with the processing of step S110 (e.g., step S120). Then, the control device 130 may wait until a high-level signal is outputted by the registration sensor 64 (e.g., step S130). That is, the control device 130 may allow the speaker 90 to continue outputting the pickup noise cancellation sound until the control device 130 detects a high-level signal outputted by the registration sensor 64. More specifically, after the control device 130 detects a high-level signal outputted by the registration sensor 64 (e.g., YES in step S130), the control device 130 may allow the speaker 90 to continue outputting the pickup noise cancellation sound until the recording sheet reaches the conveyor roller pair 58. That is, the control device 130 may stop the speaker 90 from outputting the pickup noise cancellation sound on condition that the recording sheet has reached the conveyor roller pair 58.

Then, when a leading edge of the recording sheet being conveyed in the conveyance path 65 reaches the conveyor roller pair 58 that is rotating in the reverse direction, skew of the recording sheet may be corrected. At that time, sound caused when the recording sheet is deformed by contacting the conveyor roller pair 58 may come out as the operating noise. Therefore, a noise cancellation sound (hereinafter, referred to as a "registration noise cancellation sound") having a phase reverse to a phase of such operating noise may be prestored in the EEPROM 134.

After the control device 130 determines, in step S130, that a high-level signal is outputted (e.g., YES in step S130), the control device 130 may stop the speaker 90 from outputting the pickup noise cancellation sound and allow the speaker 90 to output the registration noise cancellation sound stored in the EEPROM 134 when a predetermined time period elapses (e.g., a time required to convey a recording sheet from the registration sensor 64 to the conveyor roller pair 58 (e.g., step S140). The registration noise cancellation sound may be outputted for a short period of the time in which the skew of the recording sheet may be corrected by the conveyor roller pair 58.

Then, the control device 130 may stop rotating the sheet feed motor 102 to stop the feed roller 25 from rotating (e.g., step S150). The control device 130 may also stop rotating the conveyor motor 101 to stop the conveyor roller pair 58 from rotating. At that time, the control device 130 may stop the speaker 90 from outputting the registration noise cancellation sound. Thus, the sheet feeding process (e.g., step S10) depicted in FIG. 7 may end.

Figure 9:
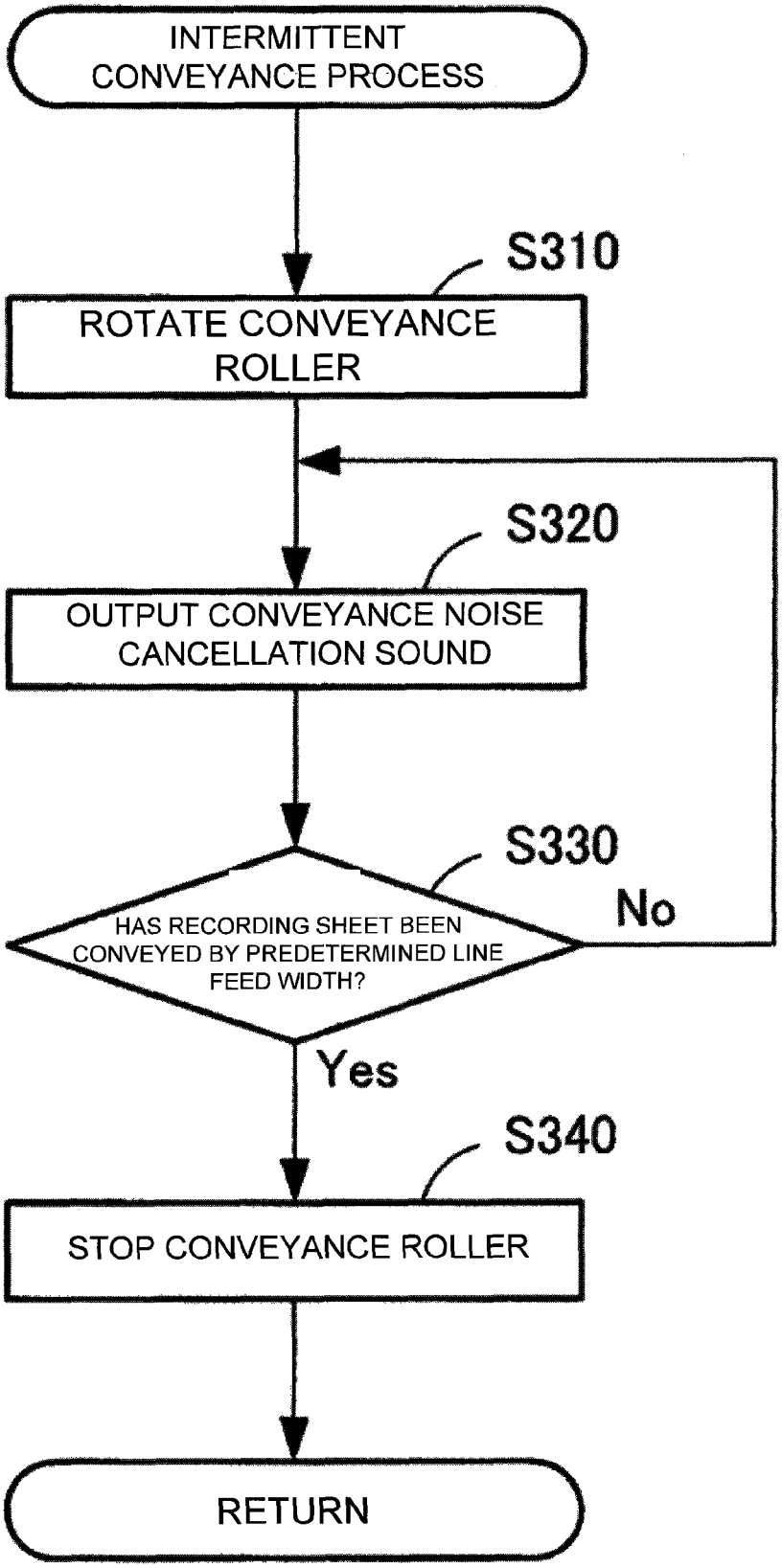
FIG. 9 is a flowchart depicting an intermittent conveyance process according to an embodiment of the invention.

Back to FIG. 7, the control device 130 may determine whether there is image data to be recorded on the same surface of the recording sheet (e.g., step S20). When there is image data to be recorded on the same surface of the recording sheet (e.g., YES in step S20), the control device 130 may perform the intermittent conveyance process (e.g., step S30). Referring to FIG. 9, the intermittent conveyance process is described in detail.

As depicted in FIG. 9, the control device 130 may drive the conveyor motor 101 in the normal direction to rotate the conveyor roller 60 in the normal direction (e.g., step S310). Thus, the recording sheet in the conveyance path 65 may be pinched and conveyed downward by the conveyor roller pair 58 along the conveyance direction. At that time, the driving sound of the conveyor motor 101 and sound caused when the recording sheet pinched by the conveyor roller pair 58 is deformed may come out as the operating noise. Therefore, a noise cancellation sound (hereinafter, referred to as a "conveyance noise cancellation sound") having a phase reverse to a phase of such operating noise may be prestored in the EEPROM 134.

The control device 130 may allow the speaker 90 to output the conveyance noise cancellation sound stored in the EEPROM 134, in synchronization with the processing of step S310 (e.g., step S320). Then, the control device 130 may wait until the recording sheet is conveyed by the predetermined line feed width (e.g., step S330). That is, the control device 130 may allow the speaker 90 to continue outputting the conveyance noise cancellation sound while the recording sheet is conveyed by the predetermined line feed width. A conveyance distance of the recording sheet may be acquired, for example, by a rotary encoder (not depicted) configured to detect a rotation amount of the conveyor motor 101 (e.g., a rotation amount of the conveyor roller 60).

After the recording sheet is conveyed by the predetermined line feed width (e.g., YES in step S330), the control device 130 may stop rotating the conveyor motor 101 to stop the conveyor roller 60 to rotate in the normal direction (e.g., step S340). Simultaneously, the control device 130 may stop the speaker 90 from outputting the conveyance noise cancellation sound. Thus, the intermittent conveyance process of FIG. 7 (e.g., step S30) may end.

Figure 10:
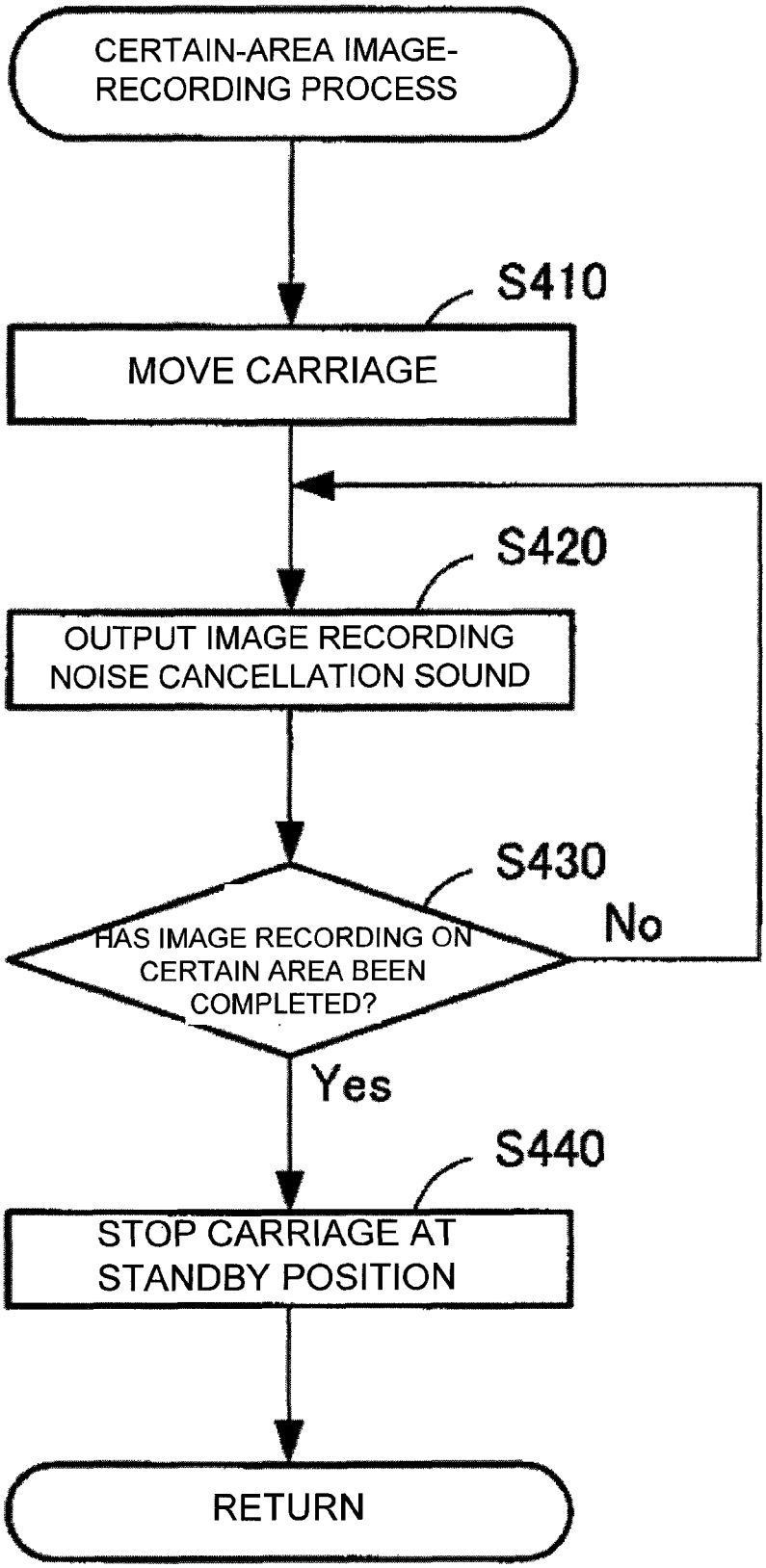
FIG. 10 is a flowchart depicting a certain-area image-recording process according to an embodiment of the invention.

Returning to FIG. 7, the control device 130 may perform a process of recording an image on a certain area of the recording sheet (hereinafter, also referred to as a "certain-area image-recording process") (e.g., step S40). Referring to FIG. 10, the certain-area image-recording process is described.

As depicted in FIG. 10, the control device 130 may drive the carriage drive motor 103 to rotate in one of the normal direction and the reverse direction to move the carriage 40 along the main scanning direction (e.g., the right-left direction 9) (e.g., step S410). The control device 130 may output a control signal to the recording head 38 via the flexible flat cable 72 to cause the nozzles to eject ink at a predetermined timing. Thus, an image may be recorded on the certain area of the recording sheet. At that time, the driving sound of the carriage drive motor 103 and sound caused when the carriage 40 slides on the guide rails 45 and 46 may come out as the operating noise. Therefore, a noise cancellation sound (hereinafter, referred to as an "image recording noise cancellation sound") having a phase reverse to a phase of such operating noise may be prestored in the EEPROM 134.

The control device 130 may allow the speaker 90 to output the image recording noise cancellation sound stored in the EEPROM 134, in synchronization with the processing of step S410 (e.g., step S420). Then, the control device 130 may wait until the image recording on the certain area is completed (e.g., step S430). That is, the control device 130 may allow the speaker 90 to continue outputting the image recording noise cancellation sound until the image recording on the certain area of the recording sheet is completed.

When the image recording on the certain area of the recording sheet is completed (e.g., YES in step S430), the control device 130 may move the carriage 40 to a standby position and then stop rotating the carriage drive motor 103 (e.g., step S440). Simultaneously, the control device 130 may stop the speaker 90 from outputting the image recording noise cancellation sound. Thus, the certain-area image-recording process of FIG. 7 (e.g., step S40) may end.

Figure 11:
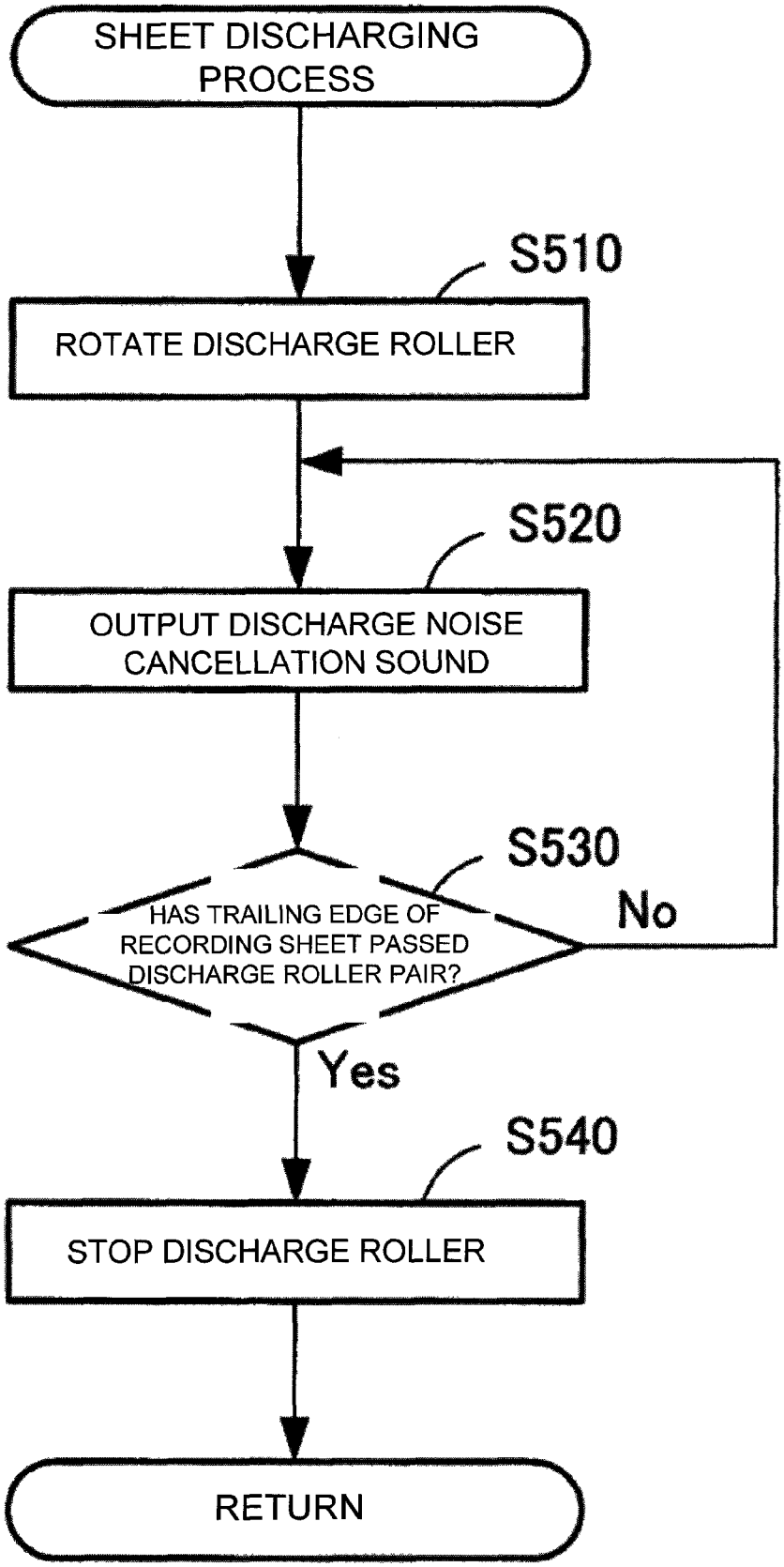
FIG. 11 is a flowchart depicting a sheet discharging process according to an embodiment of the invention.

Returning to FIG. 7 again, the control device 130 may repeat the processing of steps S30 and S40 until there is no more image to be recorded on the same surface of the recording sheet (e.g., NO in step S20). When there is no more image to be recorded on the same surface of the recording sheet (e.g., NO in step S20), the control device 130 may perform a sheet discharging process (e.g., step S50). Referring to FIG. 11, the sheet discharging process is described in detail.

As depicted in FIG. 11, the control device 130 may drive the conveyor motor 101 to rotate in the normal direction to rotate the discharge roller 62 in the normal direction (e.g., step S510). Thus, the recording sheet in the conveyance path 65 may be pinched and conveyed downward by the discharge roller pair 59 along the conveyance direction. At that time, the driving sound of the conveyor motor 101 and sound caused when the recording sheet pinched by the discharge roller pair 59 is deformed may come out as the operating noise. Therefore, a noise cancellation sound (hereinafter, referred to as a "discharge noise cancellation sound") having a phase reverse to a phase of such operating noise may be stored in the EEPROM 134.

The control device 130 may allow the speaker 90 to output the discharge noise cancellation sound stored in the EEPROM 134, in synchronization with the processing of step S510 (e.g., step S520). Then, the control device 130 may wait until a trailing edge of the recording sheet passes the discharge roller pair 59 (e.g., step S530). That is, the control device 130 may allow the speaker 90 to continue outputting the discharge noise cancellation sound until an entire portion of the recording sheet is placed on the discharge tray 21.

When the trailing edge of the recording sheet passes the discharge roller pair 59 (e.g., YES in step S530), the control device 130 may stop rotating the conveyor motor 101 to stop the discharge roller 62 to rotate in the normal direction (e.g., step S540). Simultaneously, the control device 130 may stop the speaker 90 from outputting the discharge noise cancellation sound. Thus, the predetermined sheet discharging process of FIG. 7 (e.g., step S50) may end.

Back to FIG. 7 again, the control device 130 may determine whether there is image data to be recorded on a next recording sheet (e.g., step S60). When there is image data to be recorded on the next recording sheet (e.g., YES in step S60), the control device 130 may perform the processing of steps S10 to S50 on the next new recording sheet placed in the feed tray 20. In other embodiments, for example, instead of the new recording sheet, an image may be recorded on a back surface of the recording sheet on which the image has been just recorded. In this case, instead of the sheet feeding process performed in step S10, a process of reversing the recording sheet and returning the recording sheet into the conveyance path 65 may be performed. When there is no image data to be recorded on the next recording sheet (e.g., NO in step S60), the control device 130 may end the image recording process.

According to the embodiment, the sound that may be outputted from the speaker 90 may be emitted to the outside of the multifunction device 10 via the opening 13 through the acoustic space 81, the communication groove 82, and the open space 16 or may be emitted to the outside of the multifunction device 10 from the bottom of the frame 70 through the acoustic space 81. As described above, with the provision of the large space in front of the speaker 90, the sound quality of the speaker 90 may be improved. Further, the configuration according to the embodiment might not require small holes to be defined in the wall of the housing 14 to output sound from the speaker 90, thereby preventing or reducing entry of, for example, foreign matter into the inside of the multifunction device 10.

According to the embodiment, the components that may tend to cause the operating noise mainly may be disposed adjacent to the open space 16. Therefore, the operating noise may come out to the outside of the multifunction device 10 via the opening 13 through the open space 16. Thus, the speaker 90 may be allowed to output an appropriate noise cancellation sound corresponding to the operating noise being caused. As described above, the operating noise and the noise cancellation sound may be synthesized (or cancelled each other) within the open space 16, whereby the quiet multifunction device 10 may be implemented.

According to the above-described embodiment, the speaker 90 may be disposed outside the acoustic chamber 80 and the sound output surface 91 may be exposed to the acoustic space 81 via the opening 83 of the acoustic chamber 80. Nevertheless, the disposed location of the speaker 90 might not be limited to the specific embodiment. In other embodiments, for example, as depicted in FIG. 12, the speaker 90 may be disposed inside the acoustic chamber 84, that is, within an acoustic space 85.

Figure 12:
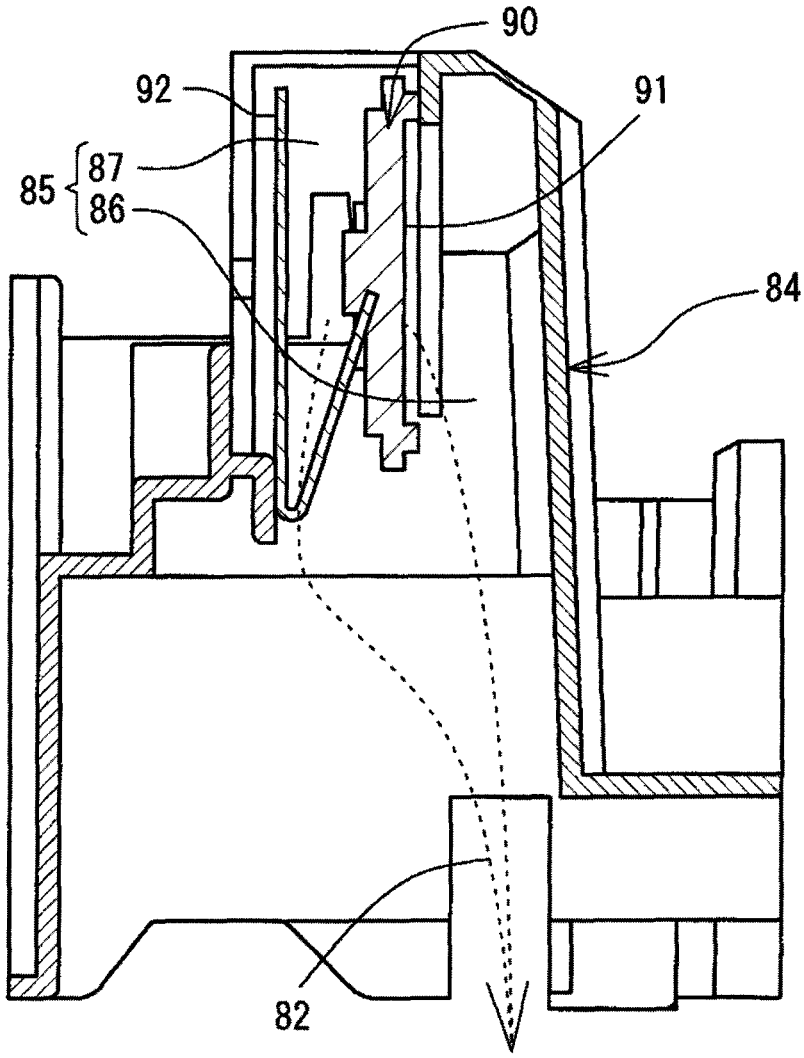
FIG. 12 is a sectional view depicting an acoustic chamber according to another embodiment of the invention.

The acoustic space 85 depicted in FIG. 12 may be partitioned into first space 86 and second space 87. The speaker 90 may be disposed in the acoustic space 85 such that the sound output surface 91 may be oriented toward the first space 86 and a rear surface, opposite to the sound output surface 91, of the speaker 90 may be oriented toward the second space 87. That is, the acoustic space 85 depicted in FIG. 12 may be partitioned into the first space 86 and the second space 87 by the speaker 90.

The first space 86 and the second space 87 may be combined into one space before the first space 86 and the second space 87 connect with the communication groove 82. That is, sound outputted into the first space 86 from the sound output surface 91 of the speaker 90 and sound outputted into the second space 87 from the rear surface, opposite to the sound output surface 91, of the speaker 90 may be synthesized before reaching the communication groove 82 as indicated by dashed lines with an arrow in FIG. 12, and the synthesized sound may be emitted into the open space 16 through the communication groove 82.

According to the above-described configuration, the acoustic chamber 84 comprising the speaker 90 therein may serve as a bass-reflex speaker to enhance a low range, particularly. Thus, the multifunction device 10 may output sound, such as a warning beep and/or voice guidance, in the low range, for, for example, seniors who may be hard to hear the high range sound. That is, the multifunction device 10 that may be capable of outputting the sound that users in wide age groups can catch may be implemented.

In the above-described embodiment, the sound output surface 91 of the speaker 90 may be in pressure contact with the front-facing wall of the acoustic chamber 80, in other words, as depicted in FIG. 2, the speaker 90 may be disposed such that the sound output surface 91 may face rearward in the front-rear direction 8. Nevertheless, the orientation of the sound output surface 91 might not be limited to the specific embodiment. In other embodiments, for example, the speaker 90 may be disposed within the acoustic space 81 such that the sound output surface 91 may face downward in the up-down direction 7.

For example, in a situation where the multifunction device 10 is installed as depicted in FIG. 1, there may be a clearance left between an installation surface where the multifunction device 10 may be installed and a bottom surface of the multifunction device 10. That is, as depicted in FIG. 1, the open space 16 may open toward the outside via not only the space left above the feed tray 20 and the discharge tray 21 but also the clearance left between the feed tray 20 and the installation surface. Therefore, as described above, when the speaker 90 is disposed such that the sound output surface 91 faces downward, the sound may be emitted positively via the clearance left between the feed tray 20 and the installation surface.

In the above-described embodiment, the sound outputted from the speaker 90 may be emitted into the open space 16 via the acoustic chamber 80. Nevertheless, the aspects of the disclosure might not be limited to the specific embodiment. In other embodiments, for example, the sound output surface 91 of the speaker 90 may be exposed to the open space 16 directly. For example, the sound output surface 91 of the speaker 90 may be exposed to the open space 16 through one of side walls, which face each other in the right-left direction 9, of the walls defining the open space 16. In this case, the speaker 90 may be disposed adjacent to the open space 16 in the right-left direction 9. For another example, the sound output surface 91 of the speaker 90 may be exposed to a back wall, facing the opening 13, of the walls defining the open space 16. In this case, the speaker 90 may be disposed adjacent to the open space 16 in the front-rear direction 8.

With this configuration, the sound outputted from the speaker 90 may be directly emitted to the outside of the multifunction device 10 via the opening 13 without traveling through the complicated route defined inside the housing 14. Therefore, it may be easy to ensure an adequate volume level.

Particularly, the conveyor roller pair 58 and the recording unit 24 may be disposed at the back of the open space 16. Therefore, the space for disposing the speaker 90 may be extremely small. With consideration given to this, a thin piezoelectric-type speaker may be adopted as the speaker 90 to place the speaker 90 in the small space.

The "walls defining the open space 16" may refer to the walls defining the end (boundary) of the open space. The open space 16 might not necessarily be defined by one or more dedicated walls. In other embodiments, for example, the open space 16 may be defined by walls of components disposed in adjacent areas of the open space 16. For example, the lower member 53 depicted in FIG. 2 may be used as one of the walls defining the open space 16.

In the above-described embodiment, an appropriate one of the noise cancellation sounds prestored in the EEPROM 134 may be outputted from the speaker 90 in synchronization with each operation performed by the components of the multifunction device 10. Nevertheless, the aspects of the disclosure might not be limited to the specific embodiment. In other embodiments, for example, a noise cancellation process may be continuously performed during the operation of the multifunction device 10. In the noise cancellation process, the operating noise may be collected by the microphone (not depicted) disposed in the multifunction device 10 and an appropriate noise cancellation sound may be generated and outputted in real time based on the collected sound. By doing so, the operating noise being actually caused by the multifunction device 10 may be cancelled. Therefore, this configuration may respond flexibly to variety of the operating noise that may vary depending on the operating conditions. The noise cancellation sound generation method for this case may be the same as the above-described, noise cancellation sound generation method, whereby the description of this method is omitted.

The disposed location of the microphone might not be limited to the particular location. In other embodiments, for example, the microphone may be disposed within the open space 16. In this case, the microphone may collect synthesized sound of the operating noise and the noise cancellation sound. Thus, the control device 130 may apply a feedback process to the noise cancellation sound generation process such that the sound collected by the microphone may become closer to no sound (i.e., the sound pressure becomes closer to 0 (zero)). By doing so, the operating noise may be cancelled further effectively.

Figure 13:
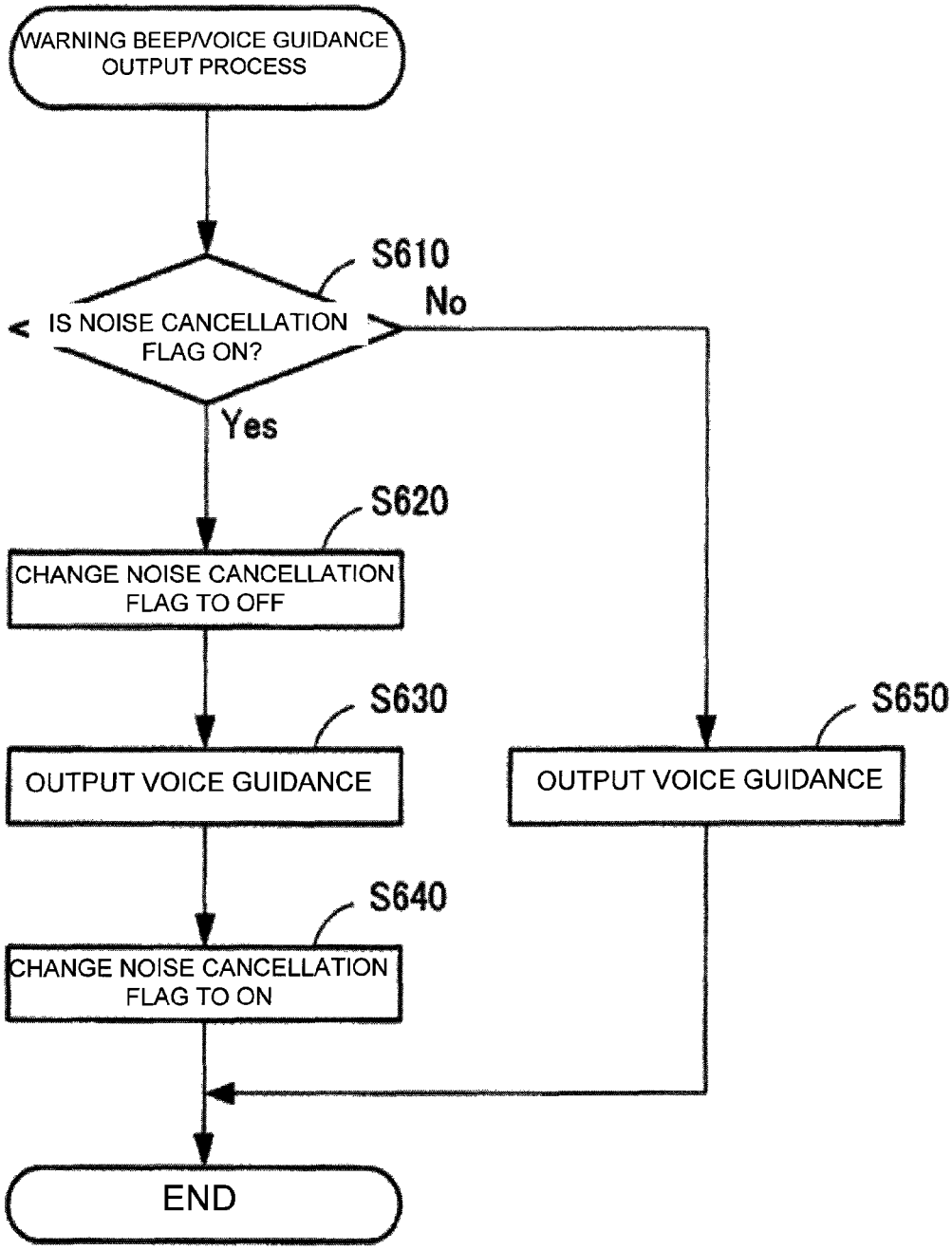
FIG. 13 is a flowchart depicting a warning beep/voice guidance output process according to yet another embodiment of the invention.

Nevertheless, according to the above-described configuration, the sound such as the warning beep and the voice guidance that should not be cancelled may be cancelled undesirably. Therefore, it may be preferable that a process may be performed in accordance with a flowchart depicted in FIG. 13 when a warning beep and/or voice guidance is outputted.

A noise cancellation flag may be maintained in the RAM 133. When the noise cancellation flag is ON (e.g., when "1" is specified), the control device 130 may continuously perform the above-described noise cancellation process. When the noise cancellation flag is OFF (e.g., when "0" is specified), the control device 130 may stop the above-described noise cancellation process. Under a normal condition, the noise cancellation flag may be ON.

Then, the control device 130 may determine the value of the noise cancellation flag maintained in the RAM 133 before outputting the warning beep and/or the voice guidance (e.g., step S610). When the noise cancellation flag is ON (e.g., YES in step S610), the control device 130 may change the noise cancellation flag to OFF (e.g., step S620) and allow the speaker 90 to output the warning beep and/or the voice guidance (e.g., step S630). After the control device 130 completes the output of the warning beep and/or the voice guidance, the control device 130 may change the noise cancellation flag to ON again (e.g., step S640). That is, the control device 130 may change the noise cancellation flag to OFF and maintain the noise cancellation flag OFF to suspend the above-described noise cancellation process while the warning beep and/or the voice guidance is outputted from the speaker 90. When the noise cancellation flag has already been OFF at the determination processing of step S610 (e.g., NO in step S610), the control device 130 may allow the speaker 90 to output a warning beep and/or voice guidance (e.g., step S650).

According to the above-described configuration, the noise cancellation process might not be performed while the warning beep and/or the voice guidance comes out. Therefore, this configuration may prevent the warning beep and the voice guidance from becoming inaudible by the cancellation of the warning beep and the voice guidance.

In the above-described embodiment and the variations, a single speaker 90 may be disposed in the multifunction device 10. Nevertheless, in other embodiments, for example, it may be needless to say that a plurality of speakers may be disposed in the multifunction device 10. To the above-described embodiment and the other embodiments, the description has been made on the precondition that the multifunction device 10 may comprise the recording unit 24 using an inkjet method. Nevertheless, the image recording method might not be limited to the inkjet method. In other embodiments, for example, any image recording method may be applied to the multifunction device 10 as a matter of course. For instance, the aspects of the disclosure may be applied to a laser printer in which toner adhered to a charged drum may be fixed onto a recording sheet to record an image on the recording sheet.

The above-described embodiment and the other embodiments may be combined in any combinations without departing from the spirit and scope of the disclosure.

What it claimed is:

1. An image recording apparatus comprising:

a sheet accommodation portion configured to accommodate a sheet therein;

a conveyance mechanism configured to convey the sheet along a conveyance direction from the sheet accommodation portion;

a recording unit configured to record an image onto the sheet conveyed by the conveyance mechanism;

a housing accommodating the conveyance mechanism and the recording unit and having therein open space that opens toward an outside of the image recording apparatus while holding the sheet accommodation portion; and a speaker disposed inside the housing and configured to output sound to the open space, wherein the speaker comprises a sound output surface configured to output the sound and is disposed such that the sound output surface is oriented toward an inside of acoustic space that is in communication with the open space, wherein the acoustic space is partitioned into first space and second space, wherein the first space and the second space are combined into one before the first space and the second space connect with the open space to communicate with each other, and wherein the speaker is disposed such that the sound output surface is oriented toward the first space and a rear surface, opposite to the sound output surface, of the speaker is oriented toward the second space.

2. The image recording apparatus according to claim 1, wherein the open space opens in a middle of a front surface of the housing in a width direction of the housing and extends inside the housing in a depth direction of the housing, and wherein the acoustic space is defined inside the housing and adjacent to the open space in the width direction.

3. The image recording apparatus according to claim 2, wherein the recording unit comprises:

a carriage configured to reciprocate in a scanning direction perpendicular to the conveyance direction; and a recording head mounted on the carriage and configured to eject ink onto the sheet, wherein the housing comprises:

a cartridge accommodation portion disposed adjacent to the open space in the width direction and configured to accommodate an ink cartridge for storing therein ink to be supplied to the recording head; and a waste ink storage portion disposed behind and adjacent to the cartridge accommodation portion and configured to store waste ink ejected from the recording head, and wherein the acoustic space is defined behind and adjacent to the waste ink storage portion.

4. The image recording apparatus according to claim 1, wherein the open space opens in a middle of a front surface of the housing in a width direction of the housing and extends inside the housing in a depth direction of the housing, and wherein the speaker comprises a sound output surface configured to output the sound and is disposed, such that the sound output surface is exposed to the open space, through a wall defining the open space inside the housing.

5. The image recording apparatus according to claim 4, wherein the speaker is disposed, such that the sound output surface is exposed to the open space, through one of side walls, which face each other in the width direction, and which define at least a portion of the open space.

6. The image recording apparatus according to claim 4, wherein the conveyance mechanism and the recording unit are disposed inside the housing and adjacent to the open space in the depth direction of the housing, wherein the speaker is a piezoelectric-type speaker configured to output the sound by an application of voltage to a piezoelectric body of the speaker, and wherein the speaker is disposed such that the sound output surface is exposed to the open space through a back wall, facing the opening, of walls defining the open space.

7. The image recording apparatus according to claim 1, wherein the speaker is manufactured by a micro-electro-mechanical systems ("MEMS") method.

8. The image recording apparatus according to claim 1, further comprising:

a storage unit configured to store a noise cancellation sound having a phase reverse to a phase of operating noise caused by an operation of at least one of the conveyance mechanism and the recording unit; and a control device configured to allow the speaker to output the noise cancellation sound stored in the storage unit in synchronization with the operation of the at least one of the conveyance mechanism and the recording unit.

9. The image recording apparatus according to claim 8, wherein the conveyance mechanism comprises:

a feed roller configured to feed the sheet from the sheet accommodation portion; and a conveyor roller disposed upstream of the recording unit in the conveyance direction and configured to convey the sheet fed by the feed roller in the conveyance direction, wherein the storage unit is configured to store the noise cancellation sound having the phase reverse to the phase of the operating noise caused by the feed roller, and wherein the control device is further configured to allow the speaker to output the noise cancellation sound when the feed roller starts feeding the sheet and to stop the speaker from outputting the noise cancellation sound when the conveyor roller starts conveying the sheet.

10. The image recording apparatus according to claim 8, wherein the conveyor roller is configured to convey the sheet intermittently by a predetermined line feed width, wherein the storage unit configured to store the noise cancellation sound having the phase reverse to the phase of the operating noise caused by the conveyor roller, and wherein the control device is further configured to allow the speaker to output the noise cancellation sound when the conveyor roller starts conveying the sheet by the predetermined line feed width and to stop the speaker from outputting the noise cancellation sound when the conveyor roller completes the conveyance of the sheet by the predetermined line feed width.

11. The image recording apparatus according to claim 8, wherein the recording unit comprises:

a carriage configured to reciprocate in a scanning direction perpendicular to the conveyance direction; and a recording head mounted on the carriage and configured to eject ink onto the sheet from nozzles, wherein the recording unit is configured to record an image onto the sheet by certain area that faces an area where the nozzles are defined in the recording head, wherein the storage unit is configured to store the noise cancellation sound having the phase reverse to the phase of the operating noise caused by the recording unit, and wherein the control device allows the speaker to output the noise cancellation sound when the recording unit starts recording and image on the certain area and to stop the speaker from outputting the noise cancellation sound when the recording unit completes the image recording on the certain area.

12. The image recording apparatus according to claim 8, wherein the conveyance mechanism is disposed downstream of the recording unit in the conveyance direction and comprises a discharge roller configured to convey the sheet on which an image has been recorded by the recording unit, along the conveyance direction, wherein the storage unit is configured to store the noise cancellation sound having the phase reverse to the phase of the operating noise caused by the discharge roller, and wherein the control device allows the speaker to output the noise cancellation sound when the discharge roller starts conveying the sheet and to stop the speaker from outputting the noise cancellation sound when a trailing edge of the sheet passes the discharge roller.

13. The image recording apparatus according to claim 1 further comprising a microphone configured to collect operating noise caused by an operation of at least one of the conveyance mechanism and the recording unit, and wherein the control device is further configured to generate a noise cancellation sound having a phase reverse to a phase of the operating noise collected by the microphone and to allow the speaker to output the generated noise cancellation sound.

* * * * *